United States Patent [19]

Brass et al.

[11] Patent Number: 4,612,880

[45] Date of Patent: Sep. 23, 1986

[54] METHOD FOR CONTROL OF OCTANE REQUIREMENT INCREASE IN AN INTERNAL COMBUSTION ENGINE HAVING MANIFOLD AND/OR COMBUSTION SURFACES WHICH INHIBIT THE FORMATION OF ENGINE DEPOSITS

[75] Inventors: Stephen Brass, Fullerton; Michael C. Croudace, Huntington Beach; Timothy Wusz, Anaheim, all of Calif.

[73] Assignee: Union Oil Company of California, Los Angeles, Calif.

[21] Appl. No.: 714,963

[22] Filed: Mar. 21, 1985

Related U.S. Application Data

[63] Continuation-in-part of Ser. No. 565,986, Dec. 27, 1983, Pat. No. 4,525,174, which is a continuation-in-part of Ser. No. 451,279, Dec. 20, 1982, Pat. No. 4,444,565.

[51] Int. Cl.[4] ..... F02B 75/12

[52] U.S. Cl. ..... 123/1 A; 123/66; 123/668; 123/669; 44/69; 44/70

[58] Field of Search ..... 123/668, 669, 1 A; 44/70, 68, 69

[56] References Cited

U.S. PATENT DOCUMENTS

| | | | |
|---|---|---|---|
| 2,210,942 | 8/1940 | Lipkin | 44/70 |
| 2,334,006 | 11/1943 | Holm | 44/70 |
| 2,810,736 | 10/1957 | Catlin et al. | 44/68 |
| 2,818,416 | 12/1957 | Brown et al. | 123/1 A |
| 2,988,564 | 6/1961 | Granam | 44/68 |
| 3,009,793 | 11/1961 | Eckert et al. | 44/70 |
| 3,046,318 | 7/1962 | Ayers et al. | 44/70 |
| 3,083,088 | 4/1963 | Carlson et al. | 44/69 |
| 3,085,002 | 4/1963 | Lauer | 44/69 |
| 3,353,938 | 11/1967 | Niedzielski | 44/68 |
| 3,421,867 | 1/1969 | Heisler et al. | 44/70 |
| 3,911,891 | 10/1975 | Dowell | 123/669 |
| 4,074,671 | 2/1978 | Pennila | 123/668 |
| 4,495,907 | 1/1985 | Kamo | 123/669 |

*Primary Examiner*—E. Rollins Cross

*Attorney, Agent, or Firm*—Dean Sandford; Gregory F. Wirzbicki; Robert J. Baran

[57] ABSTRACT

The control of the octane requirement increase phenomenon in an internal combustion engine is achieved by introducing into an internal combustion engine, having manifold and/or combustion surfaces which inhibit the formation of engine deposits, along with the combustion charge, a fuel composition containing an octane requirement increase-inhibiting amount of (a) an oil-soluble iron compound and (b) carboxylic acids and/or ester derivatives thereof. In particular the esters of a tertiary alcohol and an unsubstituted, mono-carboxylic acid having at least two carbon atoms, e.g., t-butylacetate, in combination with dicyclopentadienyl iron provides an effective octane requirement increase-inhibiting additive for said internal combustion engine. Preferably the manifold and combustion surfaces of said internal combustion engine are coated with a low density alumina or zirconia coating. More preferably said alumina or zirconia coating further comprises a carbon gasification catalyst, e.g. a nickel, cobalt and manganese-containing catalyst or an iron, copper and cerium-containing catalyst, dispersed therein.

55 Claims, No Drawings

METHOD FOR CONTROL OF OCTANE REQUIREMENT INCREASE IN AN INTERNAL COMBUSTION ENGINE HAVING MANIFOLD AND/OR COMBUSTION SURFACES WHICH INHIBIT THE FORMATION OF ENGINE DEPOSITS

FIELD OF THE INVENTION

This invention relates to a method to control the octane requirement increase (ORI) phenomenon conventionally observed during the initial portion of the operating life of spark ignition internal combustion engines. Moreover, this invention relates to coatings for the manifold and combustion surfaces of internal combustion engines which inhibit the build-up of deposits resulting from a combustion process occurring in the engine.

DESCRIPTION OF THE ART

The octane requirement increase (ORI) effect exhibited by internal combustion engines, e.g., spark ignition engines, is well known in the art. This effect may be described as the tendency for an initially new or clean engine to require higher octane quality fuel as operating time accumulates and is coincidental with the formation of deposits in the region of the combustion chamber of the engine. Thus, during the initial operation of a new or clean engine, a gradual increase in octane requirement (OR), i.e., fuel octane number required for knock-free operation, is observed with an increasing buildup of combustion chamber deposits until a rather stable or equilibrium OR level is reach, which, in turn, seems to correspond to a point in time where the quantity of deposit accumulation on the combustion chamber and valve surfaces no longer increases but remains relatively constant. This so-called "equilibrium value" is usually reached between about 3,000 and 20,000 miles or corresponding hours of operation. The actual equilibrium value of this increase can vary with engine design and even with individual engines of the same design; however, in almost all cases the increase appears to be significant, with ORI values ranging from about 2 to 14 Research Octane Numbers (RON) being commonly observed in modern engines.

It is also known that additives may prevent or reduce deposit formation, or remove or modify formed deposits, in the combustion chamber and adjacent surfaces and hence decrease OR. Such additives are generally known as octane requirement reduction (ORR) additives.

For example, in U.S. Pat. No. 4,264,335 to Bellow et al., the cerous or ceric salt of 2-ethylhexanoate is disclosed as a useful additive for suppressing the octane requirement increase of a gasoline fired internal combustion engine. It is noted in this patent that the above salt has no effect on combustion efficiency of a gasoline and does not provide anti-knock properties.

In U.S. Pat. No. 4,357,148 to Graiff there is disclosed an additive for controlling or reversing the octane requirement increase of a spark ignition internal combustion engine which comprises a combination of (a) certain oil soluble aliphatic polyamines and (b) certain low molecular weight polymers and/or copolymers of mono-olefins having up to 6 carbon atoms.

U.S. Pat. No. 3,506,416 to Patinkin et al. discloses an additive to inhibit octane requirement increase of a spark ignition engine which comprises a gasoline soluble metal salt of a hydroxamic acid. This additive is disclosed as useful in leaded gasolines. Although iron is within the broad group of metal salts of hydroxamic acid that are disclosed as a suitable additive for suppression of octane requirement increase, no data demonstrating its effectiveness are given. In fact, the patentees point out that nickel and cobalt are especially preferred for their additive.

Other references describing additives for inhibiting octane requirement increase include U.S. Pat. Nos. 3,144,311 and 3,146,203 which disclose the utilization of nitrogen ring compounds in combination with an organometallic primary antiknock agent and a minor amount of an ignition control additive selected from the group consisting of phosphorus and boron compounds.

Another approach to controlling the ORI of an internal combustion engine suggests coating at least a portion of the surfaces of the intake manifold exposed to the combustion charge, and/or the combustion chamber with a material having the combination of thermal conductance and thermal penetration which permits the temperature of said surfaces, during the combustion process, to be in excess of the temperature at which deposits form, while storing insufficient heat to substantially raise the temperature of the incoming combustion charge during the engine intake and compression stroke. (It is known that "knockingy" results from heating the combustion charge to a temperature at which preignition occurs.) For an example of ORI-controlling coatings, see U.S. Pat. No. 4,398,527 to Rynbrandt. It will be appreciated that the proper combination of thermal conductance and thermal penetration properties for said coatings, to achieve the desired control of ORI is not easily obtained. For other references which relate to coating or varying the combustion surfaces of spark-ignited internal combustion engines, for various reasons, see U.S. Pat. Nos. 3,408,995 to Johnson; 2,151,428 to Janeway; 2,914,048 to Philipp; 3,019,277 and 3,066,663 to Rudy; 3,459,167 and 3,552,370 to Briggs et. al.; 3,709,772 to Rice; 3,820,523 to Showalter et al., 3,855,986 to Wiss; 3,911,891 to Dowell; and 4,074,671 to Pennila. In particular, U.S. Pat. No. 3,408,995 like the Rynbrandt patent, is related to removing or inhibiting deposits on the combustion surfaces.

There are other references which are concerned with modifying the internal surfaces of ovens to inhibit deposits on said surfaces and thereby rendering said ovens self-cleaning. See, for example, U.S. Pat. No. 3,460,523; 3,549,419 and 3,738,350 and Great Britian Pat. No. 1,197,067 to Stiles et al.

In view of the above, it is clear that there is a continuing effort to control ORI by developing suitable fuel additives and coatings for the manifold and combustion surfaces of combustion engines.

It is therefore one object of this invention to provide a method of coating the manifold and combustion surfaces of internal combustion engines to inhibit the build-up of deposits resulting from a combustion process occurring in said engine.

It is another object of this invention to provide an improved method for controlling the ORI of an internal combustion engine, having manifold and combustion surfaces which inhibit the build-up of deposits resulting from a combustion process, by providing an additive in the combustion charge to assist said surfaces in inhibiting or reversing the ORI of said engine.

It is another object of the instant invention to provide an internal combustion engine, e.g. a spark-ignited internal combustion engine, having combustion surfaces which are resistant to ORI.

Other objects are to provide new coating compositions for controlling the ORI of internal combustion engines and to advance the art.

Other objects and advantages of the instant invention will become apparent to those skilled in the art from the following description.

SUMMARY OF THE INVENTION

It has now been found that, when a minor amount of a combination comprising (a) an oil soluble iron compound and (b) one or more carboxylic acids and/or ester derivatives thereof, and a major amount of a hydrocarbon fuel are introduced with the combustion charge to an internal combustion engine, having manifold and/or combustion surfaces which inhibit the formation of deposits resulting from combustion thereon, a significant inhibition and/or reduction in ORI is achieved.

Accordingly, the invention, provides a method for operating an internal combustion engine, which may be either a spark-ignited or compression-ignited internal combustion engine, having either or both the manifold and combustion surfaces, provided with a coating which inhibits the formation of engine deposits thereon, to reduce or inhibit the ORI of said engine, which method comprises introducing with the combustion intake charge to said engine an octane requirement increase-inhibiting amount of (a) an oil-soluble iron compound, e.g. dicyclopentadienyliron and (b) a carboxylic acid and/or an ester derivative thereof, preferably wherein said carboxylic acid is a carboxylic acid having at least two carbons and more preferably an unsubstituted monocarboxylic acid.

The present invention further includes a novel coating composition which provides a low density alumina or zirconia matrix including a carbon gasification catalyst dispersed therein. Said coating composition may be utilized to coat either or both of the manifold or combustion surfaces of an internal combustion engine to provide surfaces which inhibit the build-up of deposits resulting from the combustion of a hydrocarbon fuel in said engine and thereby control the ORI of said engine. Preferably said carbon gasification catalyst comprises a combination of nickel, cobalt and manganese or iron, copper and cerium.

Finally the invention provides a novel internal combustion engine, which is resistant to ORI, having either or both of the manifold and combustion surfaces coated with a low density alumina or zirconia matrix including a carbon gasification catalyst dispersed therein.

DETAILED DESCRIPTION OF INVENTION

The oil-soluble iron compound that is used in the method of the present invention is well-known in the art. For example, see the oil-soluble iron compounds disclosed in the U.S. Pat. Nos. 3,341,311, to Pedersen; 3,353,938, to Niedzielski; and 4,139,349, to Payne, which are herein incorporated by references for the disclosure of suitable oil-soluble iron compounds. In addition to the iron compounds disclosed in the above patents, the carbonyl derivatives disclosed in an article, by G. H. Unzelman et al., entitled "Are There Substitutes for Lead Anti-Knocks?", *AICHE Vol.* 22, *No.* 4, beginning at page 701, may also be utilized. Additional suitable oil-soluble iron compounds include the iron salts of organic acids such as iron napthanate, iron stearate, and iron oleate, etc. and iron complexes such as iron acetylacetonate, etc.

Preferably, the oil-soluble iron compound is selected from the group consisting of dicyclopentadienyl iron and the substituted derivatives thereof. These materials are generally more available and are more stable and safe than the various iron carbonyl complexes disclosed in the above references. In particular, it is preferred that the oil-soluble iron carbonyl compound is dicyclopentadienyl iron or a substituted dicyclopentadienyl iron wherein one or both of the cyclopentadienyl ring may be substituted with one to two lower alkyl groups. For example, alkyl substituted dicyclopentadienyl iron wherein said alkyl substituents are $C_1$ to $C_3$ alkyl groups are especially preferred.

The most preferred oil-soluble iron compound is dicyclopentadienyl iron because of its stability and availability.

Any carboxylic acid or ester derivative thereof that may be volatilized with and solubilized in gasoline may be used in the method of this invention. Carboxylic acids having a single carboxylic group, i.e., monocarboxylic acids and at least two carbon atoms but no more than about 10 carbon atoms are preferred.

A $C_2$ to $C_4$ monocarboxylic acid is more preferred for use in this invention, while the most preferred carboxylic acid is acetic acid.

The carboxylic acid will preferably be free from hetero atoms such as sulfur, halogen, etc., i.e., it will include only carbon, hydrogen and oxygen atoms therein. Preferably the carboxylic acid is reacted with an alcohol, and more a tertiary alcohol to provide a tertiary ester. The alcohol may be a $C_1$ to $C_{10}$ alcohol, preferably a saturated alcohol. An especially preferred tertiary alcohol ester is tertiary butyl acetate, which when combined with dicyclopentadienyl iron provides a surprising increase in inhibition of the octane requirement increase of an engine.

The iron content of the fuel utilized in the method of this invention is usually between 0.0001 and 10 grams per gallon of the fuel. Preferably, the iron content of said fuel will range from about 0.001 to about 5 grams per gallon of fuel. At a level lower than about 0.0001 grams per gallon of fuel, the desired inhibition of the octane requirement increase may not be observed, while iron concentrations of greater than about 10 grams per gallon of fuel are expected to lead to excessive engine wear. The preferred upper level for the iron concentration is selected to balance the cost of increasing the concentration of oil-soluble iron compound with a decreasing benefit by way of inhibition of octane requirement increase.

The amount of carboxylic acid and/or the ester derivative thereof which is provided in the fuels utilized in the method of the instant invention will usually be at least about 0.001 grams per gallon of fuel and preferably from about 0.001 to about 10 grams per gallon of fuel. The carboxylic acid and/or derivative thereof may be adjusted based on the amount of iron provided in the fuel. For example, from about 1 to about 5 moles of carboxylic acid or the ester derivative thereof may be provided per gram-atom of iron. It is noted that the preferred tertiary alcohol esters have anti-knock properties of their own and therefore greater concentrations are not undesirable, provided there is no economic debit. However, to obtain the desired inhibition of octane requirement increase, no more than about 10 grams of a tertiary alcohol ester per gallon of fuel is necessary.

Suitable liquid hydrocarbon fuels of the gasoline boiling range are mixtures of hydrocarbons having a boiling range of from about 25° C. (77° F.) to about 232° C. (450° F.), and often comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer and trimerized olefins, synthetically-produced hydrocarbon mixtures, from thermally or catalytically reformed hydrocarbons, or from catalytically cracked or thermally cracked petroleum stocks, and mixtures of these. The hydrocarbon composition and octane level of the base fuel are not critical.

The hydrocarbon fuel mixtures which are utilized in the present invention may contain minor amounts of blending agents such as methanol, ethanol, methyl tertiary butyl ether, and the like. The fuels may also contain antioxidants such as phenolics, e.g., 2,6-di-tert-butylphenol or phenylenediamines, metal deactivators, dehazers such as polyester-type ethoxylated alkylphenol-formaldehyde resins and the like. The fuels may also contain antiknock compounds such as tetraethyl lead, a methyl cyclopentadienylmanganese tricarbonyl, ortho-azidophenol and the like.

The oil-soluble iron compound and the oil-soluble oxygen compound utilized in the method of the present invention may be introduced into the combustion zone of the engine in a variety of ways to prevent buildup of deposits. For example, said oil-soluble compounds may be injected into the intake manifold intermittently or substantially continuously, preferably in a hydrocarbon carrier having a final boiling point (by ASTM D86) lower than about 232° C. (450° F.). Preferably, said oil-soluble compounds are added to the fuel, e.g. either separately or blended with other fuel additives.

In the internal combustion engine utilized in the method of the present invention, either or both of the manifold and/or the combustion surfaces have a combination of thermal conductance and thermal penetration which permits the temperature of said surfaces, during the combustion process, to be in excess of the temperature at which deposits form, while storing insufficient heat to substantially raise the temperature of the incoming combustion charge during the intake and compression stroke. Certain coatings, having the proper thermal conductance and penetration properties, are described in U.S. Pat. No. 4,398,527 to Rynbrandt, herein incorporated by reference.

Said coatings may be used in any internal combustion engine and particularly the common reciprocating-piston internal combustion engine. The coating may be applied to the surfaces of a conventional combustion chamber and intake manifold of a 4-cycle engine. In accordance with the present invention, at least a portion of one or more of the combustion chamber surfaces, the intake valve, the exhaust surfaces and intake manifold surfaces are coated with a material having the recited thermal parameters such as a thermally stable, resinous closed-cell foam or an inorganic refractory oxide sponge of about 0.02 mm to about 1 mm thickness and preferably, 0.04 mm to 0.2 mm.

At least a portion of the unwiped surface of the combustion chamber is preferably coated, in particular, the cylinder head, the face of the intake valve and the piston top surface (i.e., the portion exposed to combustion), and at least a portion of the intake manifold surface is also coated. In particular, the intake manifold chamber and the tulip portion of the intake valve, which for convenience may be considered part of the intake manifold surface, is coated. It is, however, more important to coat the surfaces of the combustion chamber than the intake manifold surfaces to obtain the benefits of the present invention.

The coating can be either an integral part of the combustion chamber surface, fabricated during the manufacturing process, or applied as a surface coating to finished combustion chamber parts.

The requirements for the materials suitable for use in coatings for internal combustion engines utilized in the method of the present invention are expressed in terms of thermal penetration and thermal conductance. A combustion chamber with a coating of low thermal penetration and high thermal conductance provides less heat to the combustion charge than one with conventional deposits, formed from unleaded or leaded gasoline; and thus, it has a lower octane requirement than a chamber with these conventional deposits. During at least part of the combustion process, the surface temperature of the combustion chamber becomes high enough to prevent formation of conventional deposits. The coating of a combustion surface with high closed-cell void volumes may provide a surface similar to a clean metal surface and attains a temperature, during combustion, sufficient to prevent conventional deposits from forming.

The coating material can be any solid inorganic or organic material having sufficient void volume to provide the required thermal properties. Suitable organic materials are high temperature polyimide resins and resinous foams incorporating microspheres. Suitable inorganic materials are materials such as the oxides, nitrides, and carbides of Si, Ti, Cr, Ta, Nb, Zn, Zr and Al and the like, which have been modified by the incorporation of a sufficient void volume, i.e., by means of microspheres, blowing agents, or gases, and the like, or by methods of forming low-density coatings, e.g. flame spraying, etc., to come within the recited thermal conductance and thermal penetration parameters. The thickness of the coating may also be adjusted to bring the thermal conductance within the desired limits.

The surface coating functions in the combustion chamber to prevent heat loss, to prevent the permanent deposition of substances having higher heat capacity than the coating, and to promote combustion of hydrocarbons in the quench zone adjacent to the coating's free surface. It functions in the intake manifold, including the tulip portion of the intake valve, to prevent the excessive heating of the combustion charge (i.e., heating over that necessary for volatilization). Within the combustion chamber the deposit precursors are volatilized by the high temperature at the free surface of the coating during the power cycle. High surface temperatures of the coating are achieved by the selection of a coating having low heat capacity.

The coating may be used in internal combustion engines of the spark ignition and compression ignition type, such as two- or four-cycle engines, as well as rotary piston engines commonly called "Wankel" engines. The surfaces which may be coated in the internal combustion engine consist of at least a portion of the combustion chamber surface, meaning the unwiped surface which is in contact with combustion gases and including the piston top surface (i.e., the portion exposed to combustion), valve face and cylinder head; and/or intake manifold surface, meaning the surface which contacts the incoming combustion charge between the carburetor and the combustion chamber and including the intake valve tulip.

The coating may be applied by any suitable method to form a substantially uniform layer which adheres to the surface, or to a suitably prepared surface, and has a thickness of about 0.02 mm to about 1 mm, preferably about 0.2 mm to 0.4 mm, and most preferably about 0.03 mm to about 0.15 mm, for surfaces exposed to combustion. The thermal properties of the coating are such that it is durable, has low heat capacity, and is harmless to the engine, as well as, having substantial thermal stability.

At least a portion of some of the aforementioned surfaces are coated with an organic or inorganic foam or sponge. Usually, a portion of the combustion chamber, more particularly, the cylinder head, which is in contact with the combusion gases, is so coated. Generally, the piston top surface (i.e., the combustion face of the piston) is also a coated surface. The valve faces which are exposed to combustion may be coated, especially the intake valve. The surface of the intake manifold which contacts the incoming combustion charge between the carburetor and the combustion chamber may be coated with the foam or sponge, preferably those portions of the intake manifold surface which have the highest temperature due to proximity to the combustion chamber, and more particularly, the tulip portion of the intake valve. Either, or both, the combustion chamber and the intake manifold surfaces are coated, at least in part, in the aforementioned manner, but for different reasons. While the combustion chamber is coated to provide more adiabatic-like operation of the engine, i.e., reducing heat loss to the coolant at the end of the compression stroke and throughout the power stroke, as well as to reduce deposition, the intake manifold is coated to avoid excessive heating of the fuel-air charge over that necessary for volatilization of the mixture, as well as to reduce deposit build-up around the tulip of the intake valve. Manifold coating is more applicable to carbureted engines than to those using in-cylinder fuel injection.

In addition, at least a portion of the exhaust port surface area may be coated with said organic or inorganic foam to insulate the exhaust gases, thereby helping to keep the exhaust temperature higher, for use by a turbocharger, or for improved catalytic emissions control.

A thermally-stable coating should resist oxidation and decomposition even at the high surface temperatures to which it is intermittently exposed in internal combustion engines (e.g., about 400° C. and above). It owes its properties both to the materials from which it is constructed and to its manner of construction. The coating consists of a large number of voids embedded in an organic or inorganic matrix as previously recited. In particular, the void spaces may comprise about 40, or more, volume percent of the coating. The coating may be termed a "foam" or "sponge" because of the large number of voids contained therein. The voids are substantially sealed i.e., the foam or sponge is substantially closed-celled so that the pressure within a given closed-cell does not fluctuate with engine pressure cycles. A relatively simple manner of constructing the closed-cell organic foam coating utilized in the present invention is to embed a large number of preformed hollow spheres, heretofore and hereinafter called "microspheres," in a resinous matrix. Such a foam is called a "syntactic foam" (Modern Plastics Encyclopedia 1978–79, McGraw-Hill, page 145).

The microspheres may be mixed into the resin solution, and the resulting mixture cured to a rigid matrix on the above-noted surfaces. Commercially available microspheres can be made from a wide variety of inorganic and organic materials, and mixtures thereof. Suitable inorganic microspheres are selected from the group consisting of glass, ceramic, and quartz microspheres, and mixtures thereof. Suitable organic microspheres are phenol-formaldehyde plastic microspheres, and like materials. The inorganic microspheres are of about 0.01 mm to 0.2 mm average diameter and may be present in an amount of from about 40 to 80 volume percent of cured foam, and preferably from about 50 to about 65 volume percent. Organic microspheres are of about 0.01 mm to 0.1 mm average diameter and may be in an amount of from about 50 to about 70 volume percent of cured foam. Inorganic microspheres are used to add strength in addition to void volume to the closed-cell organic foam.

The organic resinous matrix material may be any resin which sets to a rigid matrix having the properties of durability and thermal stability heretofore described. Resinous composites containing resin, carbon, and/or silica are suitable. Many such resins are high-temperature polymers containing aromatic rings. For example, polyaromatics, such as polyphenylene oxides, aromatic polyesters, polyamides, polyanhydrides and polyureas having melting points greater than 300° C. are known and may be used in providing the above coatings.

Generally, most useful coatings are the inorganic sponges, e.g. the low density alumina or zirconia coatings which may be applied to the above surfaces by flame spraying.

The density of said low density alumina or zirconia coatings range from 75 to 25, more preferably from 60 to 35, percent of the density of the corresponding single crystal.

A novel coating, which may be utilized in the method of the present invention comprises a carbon gasification catalyst dispersed throughout the above-described low density alumina or zirconia coatings. Suitable carbon gasification catalyst include active metal moieties selected from the group consisting of sodium, potassium, silver, lead, copper, iron, cobalt, nickel, chromium, manganese, cerium, and combinations thereof. Preferably said active metal moieties are selected from the group consisting of nickel, manganese, cobalt, iron, copper and cerium. Such active metal moieties may be present as the oxide or other refractory form. It is believed that such active metal moieties function as carbon gasification catalysts by oxidizing the carbon to an oxide, while cycling between the oxide and metal state. It has been found that, by use of the novel coatings of this invention, the temperature, below which deposits form on the internal surfaces of the above-described internal combustion engines, is substantially lower than coatings not including a carbon gasification catalyst.

Typically, said carbon gasification catalysts may comprise at least about 0.01 percent, by weight, preferably from about 0.1 to about 10 percent, by weight of the coating. The carbon gasification catalyst may be uniformly distributed throughout the low density alumina or zirconia matrix, but is preferably concentrated at the surface exposed to combustion for maximum catalytic effect. Thus the carbon gasification catalyst may be impregnated, as a solution comprising the catalyst or a precursor thereof, onto the flame-sprayed coating of low density alumina or zirconia. Typically, the carbon gasification catalyst is applied, as an aqueous solution of water-soluble compounds comprising said catalyst, to said coating. The excess water is removed and the impregnated coating is heated to decompose the water-soluble compounds. Heating, in air, to a temperature of from about 200° C. to about 450° C., preferably 300° C. to about 400° C., is sufficient to convert the water-soluble compounds to the corresponding oxides. Water-soluble nitrate salts, which readily decompose to the oxide, in air, are especially suitable for preparing the above novel coatings.

The invention is further illustrated by the following examples which are illustrative of a specific mode of practicing the invention and are not intended as limiting the scope of the claims.

EXAMPLE I

The heads, pistons, and valves of a 1973 Chevrolet 350 CID engine are coated with low density aluminum oxide to provide a combustion chamber having a surface comprising a 500 micron coating of a low density alumina. The coating is applied by flame spraying. After flame spraying the alumina is impregnated with an aqueous iron nitrate solution, the excess water is removed, and the impregnated coating is calcined in air, at a temperature of from about 300° C. to about 400° C., to provide a carbon gasification catalyst dispersed in said alumina matrix. An ORI test is performed on the thus coated engine using a service station fuel to which a mixture comprising 0.005 gram per gallon dicyclopentadienyl iron and 0.1 gram per gallon tert-butyl acetate is added. The initial octane requirement of the coated engine using FBRU fuels, to determine octane requirement, is roughly 2.5 numbers higher than expected from an uncoated engine. However, a stabilized octane requirement corresponding to an ORI of only five octane numbers is achieved within 24 hours. An uncoated engine of the same type achieves a stabilized octane requirement corresponding to an ORI of about ten octane numbers after several hundred hours of engine operation.

After 262 hours of engine operation the above mixture is removed from the fuel. The octane requirement of the engine remains stable until an increase in octane requirement of one number is recorded approximately 320 hours after the additive is removed. Typically, an uncoated engine operated on a fuel containing a mixture of dicyclopentadienyl iron and tertiary butylacetate shows an increase in octane requirement shortly after the additive is removed. The octane requirement of the alumina-coated engine continues to increase until it stabilizes at a level two octane numbers higher than its stabilized octane requirement using the fuel containing the above mixture of dicyclopentadienyl iron and t-butyl acetate.

The engine is taken apart after nearly one thousand hours of engine operation. The coating deposited on the surfaces of the combustion chamber shows little visible damage. The coating deposited on the surfaces of the valves suffers only minor damage. However, the coating deposited on several of the piston crowns suffers moderate damage. Since the coating placed on the surface of the combustion chamber is predicted to have the the greatest effect on ORI, this result is considered very positive.

The early stabilization of octane requirement, the low ORI achieved by the coated engine, the long carry-over effect of the mixture of dicylopentadienyl iron and t-butyl acetate after it is removed from the fuel, are all surprising and unexpected.

The above-described coating may be substituted with any of the coatings described below, as well as the coatings described in U.S. Pat. No. 4,398,527, hereby incorporated by reference in its entirety. Moreover, the mixture of dicyclopentadienyl iron and t-butylacetate may be substituted with any of the mixtures of an oil-soluble iron compound and an oil-soluble oxygen-containing compounds described above.

EXAMPLE II

A Datsun 510 sedan equipped with a NAP-Z engine is utilized in this example. The NAP-Z engine is equipped with two spark plug holes per cylinder and can be operated with either one or two spark plugs per cylinder. In the spark plug hole, located in the end gas zone of the combustion chamber, a sample collection probe is inserted so that the end of the probe is flush with the surface of the combustion chamber. The octane requirements are determined for the car using PRF, 82 FBRU, and 82 FBRSU fuels. Separate octane requirements are determined for the engine configured to operate using two spark plugs per cylinder and configured to operate using one spark plug per cylinder. The procedure utilized to generate carbon deposits is described in U.S. Pat. No. 4,444,565, to Croudace, which is herein incorporated by reference. The thickness of the deposit is measured with an electron microprobe and a scanning electron microscope.

The following coatings are tested:

(1) A syntactic foam composed of glass microballoons in a polyimide matrix, (2) A syntactic foam composed of glass microballoons and a carbon gasification catalyst, comprising cobalt, manganese, and nickel supported by a lanthanide oxide, in a polyimide matrix, (3) (a) A cobalt-manganese-nickel-lanthanide carbon gasification catalyst supported by a layer of low density aluminum oxide, (b) An iron-copper-lanthanide carbon gasification catalyst supported by a layer of low density aluminum oxide, (c) A layer of low density aluminum oxide without a catalyst, (4) (a) A cobalt-manganese-nickel-lanthanide carbon gasification catalyst supported by a layer of low density zirconium oxide, (b) An iron-copper-lanthanum carbon gasification catalyst supported by a layer of low density zirconium oxide, Certain of these coating may be divided into two components, the carbon gasification catalyst and the coating matrix. The coating matrix serves to bind the carbon gasification catalyst to the engine wall and give the coating, as a whole, its thermophysical properties. The catalyst enhances the rate of gasification of hydrocarbons and other carbonaceous material deposited on the coating surface.

The coatings are prepared as follows:

Organic Syntactic Foams

The organic syntactic foam coatings are prepared by a method comprising the following steps.

(1) Ten grams of n-methyl pyrolidine, seven grams of glass microballoons, and twenty-seven grams of Monsanto Skybond 710 polyimide resin are mixed together in a glass container. Skybond 710 polyimide resin is a commercially available heat-setting polyimide resin comprising diester, diacid and diamine monomer reactants dissolved in N-methylpyrolidine.

(2) The mixture produced in step (1) is painted onto the surface of an engine probe whose surface has been roughened with sand paper and cleaned with both organic solvent and water.

(3) The carbon gasification catalyst,* if included, is sprinkled onto the painted probe of step (2), while tacky, and the excess removed by shaking.

* The Ni-Mn-Co catalyst is prepared by a method comprising the following steps:

(1) One hundred grams of mixed rare earth carbonates (50% cerium carbonate, 25% lanthanum carbonate, and 14% neodymium carbonate by weight) are slurried with 500 milliliters of distilled water in a one-liter beaker.

(2) Forty-five grams of 50% manganese nitrate solution, nine grams of nickel nitrate hexahydrate, and nine grams of cobalt nitrate hexahydrate are added to the slurry produced in step one.

(3) The resultant mixture is vigorously stirred and heated until it attains a temperature of 80° C. which is then maintained for the next two steps.

(4) Fifteen percent aqueous ammonium carbonate solution is slowly added to the mixture produced in step three until the pH of the mixture rises to 6.40±1.

(5) The solution produced in step four is digested for thirty minutes.

(6) The precipitate produced in step five is filtered and washed with 1.5 liters of distilled water.

(7) The filter cake produced in step six is immediately dried.

(8) The dried filter cake produced in step seven is calcined at 400° C. for three hours.

(4) The coating is allowed to dry overnight.

(5) The coating is heated in an oven for periods of two hours each at temperatures of 50° C., 100° C., 200° C., and 300° C.

This method produces hard nonuniform coatings on the engine probes. Typically, the coatings are thicker toward the center of the probe than they are at the edges.

Flame Sprayed Low Density Oxide Coatings

A flame spray process is utilized to coat engine probes with either low density alumina or a low density zirconia. The coatings possess a low density and therefore a low heat capacity due to the large amount of void space between the metal oxide particles. Since neither alumina nor zirconia catalyzes the gasification of carbonaceous materials by oxygen, a carbon gasification catalyst is preferably added to the low density alumina or zirconia.

The coated probes are soaked in the appropriate catalyst solution for a period of two hours.* Then the probe is either removed from the catalyst solution and heated to a temperature of 350° C. for a period of four hours or a small amount of dilute ammonium nitrate solution is added to the probe and then the probe is heated to a temperature of 350° C. for a period of four hours.

* The two catalyst solutions are prepared as follows: The first solution consists of two grams of nickel nitrate hexahydrate, two grams of cobalt nitrate hexahydrate, nine grams of 50% manganese nitrate solution dissolved in one hundred milliliters of distilled water. The second solution consists of four grams of ferric nitrate hexydrate, one and one-half grams of cupric nitrate, and two grams of cerric nitrate dissolved in one hundred milliliters of distilled water.

The ability of the test coatings to inhibit deposit formation is evaluated by comparing the thickness of the deposit formed on the test coating to the average thickness of the deposit formed on uncoated probes. The test coating is considered to have exhibited deposit-inhibiting properties if the thickness of the deposit which had formed on the test coating was less than the average thickness of deposits formed on uncoated test probes subjected to similar test conditions by an amount greater than the standard deviation of the thicknesses of the deposits formed on the uncoated probes.

The results are summarized in the Table below:

TABLE

| Coating | Thickness of Coating, microns | Thickness of Combustion Deposits, microns 4 hrs. | 24 hrs. |
|---|---|---|---|
| A. Control | — | 41 ± 7 | 132 ± 16 |
| B. Organic Syntactic Foam | 150-300 | 0 | 0 |
| C. Organic Syntactic Foam and Ni—Mn—Co Catalyst | 95 | 0 | 0 |
| D. Alumina[a] | 320 | 35 | — |
| E. Alumina[a] | 160 | — | 125 |
| F. Alumina[a] and Ni—Mn—Co Catalyst | 250 | 4-8 | |
| G. Alumina[a] and Ni—Mn Co Catalyst | 200-265 | — | 55-70 |
| H. Alumina[a] and Fe—Cu—Ce[b] | 115 | 4-8 | |
| I. Alumina[a] and Fe—Cu—Ce[b] | 330 | — | 8-12 |
| J. Alumina[a] and Fe—Cu—Ce[b] | 130 | — | 40 |
| K. Zirconia and Fe—Cu—Ce[b] | 1000 | — | 0 |
| L. Zirconia and Fe—Cu—Ce[b] | 225 | 30 | 50 |
| M. Zirconia and Fe—Cu—Ce[b] | 270 | — | |

[a]40 percent of the apparent volume comprises 25 micron voids
[b]0.1 gms/gallon of t-butylacetate added to fuel The above results show that the effectiveness of the coating depends on three factors:

(1) the thickness of the coating, (2) the density of the coating, and (3) the catalyst used.

It is found that catalyst-impregnated, low density alumina coatings are more effective in inhibiting the growth of engine deposits than are low density alumina coatings which have not been impregnated with a gasification catalyst. Furthermore, the iron-copper-cerium catalyst seems to be more effective than the cobalt-nickel-manganese catalyst.

The organic syntactic foams, while resisting the build-up of combustion deposits, appears to degrade during testing. These materials are thus not preferred.

The catalyst-impregnated zirconia coating (1000 microns) is completely clean after 24 hours. Moreover, this coating does not show any degradation.

While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method for operating an internal combustion engine with a gasoline combustion charge, which comprises introducing with said combustion charge into said engine an octane requirement increase-inhibiting amount of (a) a gasoline-soluble iron compound and (b) a gasoline-soluble oxygen-containing compound selected from the group consisting of carboxylic acids and ester derivatives thereof, said engine having a combustion surface characterized as having a combination of thermal conductance and thermal penetration properties which inhibit the build-up of deposits resulting from combustion in said engine, without substantially raising the temperature of the incoming combustion charge.

2. The method of claim 1 wherein said gasoline-soluble iron compound is selected from the group consisting of cyclopentadienyl iron and lower alkyl substituted derivatives thereof.

3. The method of claim 1 wherein said gasoline-soluble iron compound is dicyclopentadienyl iron.

4. The method of claim 1 wherein said oxygen containing compound is selected from the group consisting of the esters of $C_2$ to $C_{10}$ monocarboxylic acids.

5. The method of claim 4 wherein said ester is a derivative of a $C_2$ to $C_4$ monocarboxylic acid and a $C_4$ to $C_8$ tertiary alkyl alcohol.

6. The method of claim 5 wherein said ester is t-butyl acetate.

7. The method of claim 1 wherein said gasoline-soluble iron compound is dicyclopentadienyl iron and said oxygen-containing compound is t-butylacetate.

8. The method of claim 1 wherein said gasoline-soluble iron compound is introduced into said engine at a concentration of from at least about 0.0001 to about 10 grams of iron per gallon of the fuel component of said combustion charge.

9. The method of claim 8 wherein said gasoline-soluble oxygen-containing compound is introduced into said engine at a concentration of from at least about 0.001 to about 10 grams per gallon of the fuel component of said combustion charge.

10. The method of claim 7 wherein dicyclopentadienyl iron is introduced into said engine at a concentration of from at least about 0.001 to about 5 grams of iron and said t-butylacetate is introduced into said engine at a concentration of at least about 0.001 to about 10 grams per gallon of the fuel component of said combustion charge.

11. A method for operating an internal combustion engine with a gasoline combustion charge, which comprises introducing with said combustion charge into said engine an octane requirement increase-inhibiting amount of a gasoline-soluble iron compound and (b) a gasoline-soluble oxygen-containing compound selected from the group consisting of carboxylic acids and ester derivatives thereof, said engine having combustion surfaces coated with a low density alumina or zirconia coating.

12. The method of claim 11 wherein said coating varies in thickness from between about 50 and 1000 microns.

13. The method of claim 11 wherein said coating is of a density ranging from between 75 and 25 percent of the density of the corresponding single crystal of alumina or zirconia.

14. The method of claim 11 wherein said coating is of a density ranging from between 60 and 35 percent of the density of the corresponding single crystal of alumina or zirconia.

15. The method of claim 11 wherein a carbon gasification catalyst is dispersed within a matrix comprising a low density alumina or zirconia.

16. The method of claim 15 wherein said carbon gasification catalyst comprises a combination selected from the group consisting of (1) nickel, cobalt and maganese and (2) iron, copper and cerium.

17. The method of claim 11 wherein said coating is provided by flame spraying said surfaces with alumina or zirconia.

18. The method of claim 17 further comprising providing said coating by contacting said flame sprayed coating with an aqueous solution comprising a mixture of water-soluble salts of nickel, cobalt and manganese or iron, copper and cerium to impregnate said salts into said flame sprayed coating and heating said impregnated coating to decompose said salts to the corresponding oxides.

19. The method of claim 18 wherein said water-soluble salts are nitrates.

20. The method of claim 19 wherein said impregnated coating is heated to a temperature of from about 300° to 400° C.

21. An internal combustion engine comprising a combustion chamber having a surface exposed to combustion, wherein at least a portion of said surface has a combination of a thermal conductance and a thermal penetration which permits the temperature of said surface portion during the combustion process to be in excess of the temperature at which deposits form, but storing insufficient heat to substantially raise the temperature of the incoming combustion charge during the engine intake stroke and compression stroke, and wherein said surface portion is coated with a low density alumina or zirconia coating, and said coating further comprising a carbon gasification catalyst.

22. The internal combustion engine of claim 21 wherein said coating varies in thickness from between about 50 and 1000 microns.

23. The internal combustion engine of claim 21 wherein said coating is of a density ranging from between 75 and 25 percent of the density of the corresponding single crystal of alumina or zirconia.

24. The internal combustion engine of claim 21 wherein said coating is of a density ranging from between 60 and 35 percent of the density of the corresponding single crystal of alumina or zirconia.

25. The internal combustion engine of claim 21 wherein said carbon gasification catalyst comprises a combination of nickel, cobalt and manganese or iron, copper and cerium.

26. The internal combustion engine of claim 21 wherein said coating is provided by flame spraying said surface exposed to combustion with alumina or zirconia.

27. The internal combustion engine of claim 26 wherein said carbon gasification catalyst is provided by contacting said flame sprayed coating with an aqueous solution comprising a mixture of water-soluble salts of nickel, cobalt and manganese or iron, copper and cerium to impregnate said salts into said flame sprayed coating and heating said impregnated coating to decompose said salts to the corresponding oxides.

28. The internal combustion engine of claim 27 wherein said water-soluble salts are nitrates.

29. The internal combustion engine of claim 28 wherein said impregnated coating is heated to a temperature of from about 300° to 400° C.

30. The internal combustion engine of claim 25 wherein said coating comprises zirconia and a carbon gasification catalyst comprising iron, copper and cerium.

31. A method for operating an internal combustion engine with a gasoline combustion charge, which comprises introducing with said combustion charge into said engine an octane requirement increase-inhibiting amount of (a) a gasoline-soluble iron compound and (b) a gasoline-soluble oxygen-containing compound selected from the group consisting of carboxylic acids and ester derivatives thereof, said engine having a combustion surface characterized as having a combination of thermal conductance and thermal penetration properties to promote the gasification of carbonaceous materials.

32. The method of claim 31 wherein said gasoline-soluble iron compound is selected from the group consisting of cyclopentadienyl iron and lower alkyl substituted derivatives thereof.

33. The method of claim 31 wherein said gasoline-soluble iron compound is dicyclopentadienyl iron.

34. The method of claim 31 wherein said oxygen containing compound is selected from the group consisting of the esters of $C_2$ to $C_{10}$ monocarboxylic acids.

35. The method of claim 34 wherein said ester is a derivative of a $C_2$ to $C_4$ monocarboxylic acid and a $C_4$ to $C_8$ tertiary alkyl alcohol.

36. The method of claim 34 wherein said ester is t-butyl acetate.

37. The method of claim 31 wherein said gasoline-soluble iron compound is dicyclopentadienyl iron and said oxygen-containing compound is t-butylacetate.

38. A method as defined in claim 31 wherein the properties of said surface are further characterized in that the incoming combustion charge is not increased in temperature prior to entry into the combustion chambers of said engine, and said gasoline-soluble oxygen-containing compound has at least 2 carbon atoms.

39. The method of claim 38 wherein said gasoline-soluble iron compound is selected from the group consisting of cyclopentadienyl iron and lower alkyl substituted derivatives thereof.

40. The method of claim 38 wherein said gasoline-soluble iron compound is dicyclopentadienyl iron.

41. The method of claim 39 wherein said oxygen containing compound is selected from the group consisting of the esters of $C_2$ to $C_{10}$ monocarboxylic acids.

42. The method of claim 41 wherein said ester is a derivative of a $C_2$ to $C_4$ monocarboxylic acid and a $C_4$ to $C_8$ tertiary alkyl alcohol.

43. The method of claim 41 wherein said ester is t-butyl acetate.

44. The method of claim 38 wherein said gasoline-soluble iron compound is dicyclopentadienyl iron and said oxygen-containing compound is t-butylacetate.

45. The method of claim 11 wherein said gasoline-soluble iron compound is selected from the group consisting of cyclopentadienyl iron and lower alkyl substituted derivatives thereof and said oxygen-containing compound is selected from the group consisting of the esters of $C_2$ to $C_{10}$ monocarboxylic acids.

46. The method of claim 15 wherein said gasoline-soluble iron compound is selected from the group consisting of cyclopentadienyl iron and lower alkyl substituted derivatives thereof and said oxygen-containing compound is selected from the group consisting of the esters of $C_2$ to $C_{10}$ monocarboxylic acids.

47. The method of claim 16 wherein said gasoline-soluble iron compound is selected irom the group consisting of cyclopentadienyl iron and lower alkyl substituted derivatives thereof and said oxygen-containing compound is selected from the group consisting of the esters of $C_2$ to $C_{1O}$ monocarboxylic acids.

48. The method of claim 17 wherein said gasoline-soluble iron compound is selected from the group consisting of cyclopentadienyl iron and lower alkyl substituted derivatives thereof and said oxygen-containing compound is selected the group consisting of the esters of $C_2$ to $C_{10}$ monocarboxylic acids.

49. A method for operating an internal combustion engine with a gasoline combustion charge, whlch comprises introducing with said combustion charge into said engine an octane requirement increase-inhibiting amount of (a) a gasoline-soluble iron compound and (b) a gasoline-soluble oxygen compound selected from the group consisting of carboxylic acids and ester derivatives thereof, said engine having combustion surfaces coated with a relative low heat capacity coating.

50. The method of claim 49 wherein said gasoline-soluble iron compound is selected from the group consisting of cyclopentadienyl iron and lower alkyl substituted derivatives thereof and said oxygen-containing compound is selected from the group consisting of the esters of $C_2$ to $C_{10}$ monocarboxylic acids.

51. A method as defined in claim 50 wherein said iron compound is present at a concentration between about 0.0001 and about 0.005 gram per gallon of fuel and said oxygen-containing compound between about 0.0001 and about 0.1 gram per gallon of fuel.

52. A method as defined in claim 11 wherein said iron compound is present at a concentration between about 0.0001 and about 0.005 gram per gallon of fuel and said oxygen-containing compound between about 0.001 and about 0.1 gram per gallon of fuel.

53. A method as defined in claim 4 wherein said iron compound is present at a concentration between about 0.0001 and about 0.005 gram per gallon of fuel and said oxygen-containing compound between about 0.001 and about 0.1 gram per gallon of fuel.

54. A method as defined in claim 31 wherein said iron compound is present at a concentration between about 0.0001 and about 0.005 gram per gallon of fuel and said oxygen-containing compound between about 0.001 and about 0.1 gram per gallon of fuel.

55. A method as defined in claim 39 wherein said iron compound is present at a concentration between about 0.0001 and about 0.005 gram per gallon of fuel and said oxygen-containing compound between about 0.001 and about 0.1 gram per gallon of fuel.

* * * * *

UNITED STATES PATENT AND TRADEMARK OFFICE

CERTIFICATE OF CORRECTION

PATENT NO. : 4,612,880

DATED : 09/23/86

INVENTOR(S) : Brass, Croudace and Wusz

It is certified that error appears in the above-identified patent and that said Letters Patent is hereby corrected as shown below:

Claim 11, col. 13, line 54, insert --(a)-- between "of" and "a".

Claim 51, col. 16, line 40, delete "0.0001" and insert therefor --0.001--.

Signed and Sealed this

First Day of December, 1987

*Attest:*

DONALD J. QUIGG

*Attesting Officer*

*Commissioner of Patents and Trademarks*